US008967836B2

(12) United States Patent
Min et al.

(10) Patent No.: US 8,967,836 B2
(45) Date of Patent: Mar. 3, 2015

(54) LIGHT HAVING A LENS AND BODY WITH A THREADED CONNECTION AND A GROOVE AND A PROTRUSION CONNECTION THEREBETWEEN

(71) Applicants: Byeongguk Min, Seoul (KR); Jaeo Kwak, Seoul (KR); Seungkyun Hong, Seoul (KR); Insoo Park, Seoul (KR)

(72) Inventors: Byeongguk Min, Seoul (KR); Jaeo Kwak, Seoul (KR); Seungkyun Hong, Seoul (KR); Insoo Park, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/759,581

(22) Filed: Feb. 5, 2013

(65) Prior Publication Data

US 2014/0029268 A1 Jan. 30, 2014

(30) Foreign Application Priority Data

Jul. 27, 2012 (KR) ..... 10-2012-0082218

(51) Int. Cl.

| | |
|---|---|
| ***F21V 3/00*** | (2006.01) |
| ***F21V 17/12*** | (2006.01) |
| ***F21K 99/00*** | (2010.01) |
| ***F21V 5/00*** | (2006.01) |
| ***F21V 17/10*** | (2006.01) |

(52) U.S. Cl.

CPC ..... *F21V 17/12* (2013.01); *F21K 9/137* (2013.01); *F21V 5/00* (2013.01); *F21V 17/101* (2013.01)

USPC ..... 362/311.03; 362/249.02

(58) Field of Classification Search

USPC ..... 362/373, 500, 249.02, 311.03, 311.02; 313/498–512

See application file for complete search history.

(56) References Cited

U.S. PATENT DOCUMENTS

| | | | | |
|---|---|---|---|---|
| 6,607,286 | B2 * | 8/2003 | West et al. | 362/255 |
| 6,653,157 | B2 * | 11/2003 | Kondo | 438/22 |
| 7,628,513 | B2 * | 12/2009 | Chiu | 362/311.02 |
| 7,874,710 | B2 * | 1/2011 | Tsai et al. | 362/373 |
| 7,976,211 | B2 * | 7/2011 | Cao | 362/650 |
| 8,157,422 | B2 * | 4/2012 | Paik et al. | 362/294 |
| 8,210,735 | B2 * | 7/2012 | Choi | 362/650 |
| 8,303,137 | B2 * | 11/2012 | Paik et al. | 362/294 |

OTHER PUBLICATIONS

Merriam-webster online dictionary, 2014, merriam-webster incorporated.*

* cited by examiner

*Primary Examiner* — Tracie Y Green
(74) *Attorney, Agent, or Firm* — Ked & Associates, LLP

(57) ABSTRACT

Disclosed is a lighting device including a body having an inside wall to provide a cavity, the inside wall being provided with a first screw, a light source disposed in the cavity, a power supply disposed at one side of the body to supply power to the light source, and a lens disposed on the light source, the lens being provided with a second screw coupled to the first screw. Disclosed is also a lighting device including a body having an inside wall to provide a cavity, the inside wall being provided with a first screw, a light source disposed in the cavity, a power supply disposed in the body to supply power to the light source, and a lens disposed on the light source, the lens being provided with a second screw coupled to the first screw so that the lens is spaced from the light source.

17 Claims, 9 Drawing Sheets

LIGHT HAVING A LENS AND BODY WITH A THREADED CONNECTION AND A GROOVE AND A PROTRUSION CONNECTION THEREBETWEEN

CROSS-REFERENCE TO RELATED APPLICATION

This application claims the priority benefit of Korean Patent Application No. 10-2012-0082218, filed on Jul. 27, 2012 in the Korean Intellectual Property Office, the disclosure of which is incorporated herein by reference.

BACKGROUND

1. Field

Embodiments relate to a lighting device.

2. Description of the Related Art

In general, indoor or outdoor light bulbs or fluorescent lights are widely used. Light bulbs or fluorescent lights should be frequently replaced due to short lifespan thereof. Also, conventional fluorescent lights deteriorate and luminance gradually decreases with time.

In order to solve these problems, a variety of types of lighting modules using light-emitting diodes (LEDs) capable of realizing superior control, rapid response speed, high electric light conversion efficiency, long lifespan, low consumption power, superior brightness and sensitive lighting are developed.

Light emitting diodes (LEDs) are devices which convert electric signals into light using characteristics of compound semiconductors. Light emitting diodes (LEDs) have advantages of low consumption power, semi-permanent lifespan, rapid response speed, safety and eco-friendliness, as compared to conventional light sources such as fluorescent and incandescent lighting. Accordingly, a great deal of research to replace conventional light sources with light emitting diodes is underway and use of LEDs as light sources of lighting devices such as indoor and outdoor liquid crystal display devices, electronic signboards and streetlights is increasing.

SUMMARY

Embodiments provide a lighting device in which a lens is coupled to a body by screw coupling to stabilize physical durability and light orientation.

In one embodiment, a lighting device includes: a body having an inside wall to provide a cavity, the inside wall being provided with a first screw; a light source disposed in the cavity; a power supply disposed at one side of the body to supply power to the light source; and a lens disposed on the light source, the lens being provided with a second screw coupled to the first screw.

In another embodiment, a lighting device includes: a body having an inside wall to provide a cavity, the inside wall being provided with a first screw; a light source disposed in the cavity; a power supply disposed in the body to supply power to the light source; and a lens disposed on the light source, the lens being provided with a second screw coupled to the first screw so that the lens is spaced from the light source.

BRIEF DESCRIPTION OF THE DRAWINGS

Details of the embodiments will be more clearly understood from the following detailed description taken in conjunction with the accompanying drawings, in which.

DETAILED DESCRIPTION OF EMBODIMENTS

Figure 1:
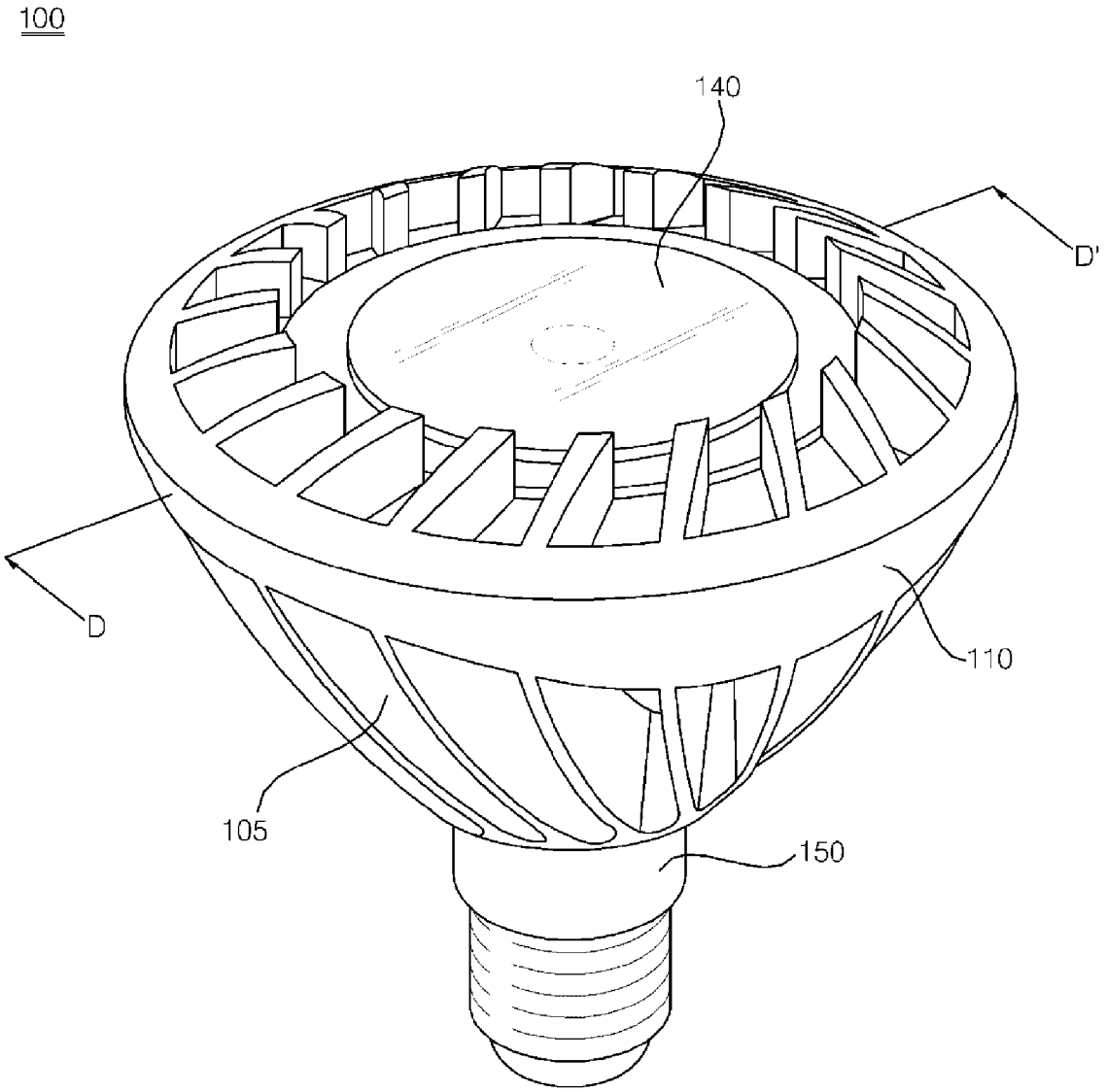
FIG. 1 is a perspective view illustrating the structure of a lighting device according to one embodiment.

Reference will now be made in detail to embodiments, examples of which are illustrated in the accompanying drawings. However, the present disclosure may be embodied in many different forms and should not be construed as limited to the embodiments set forth herein. Rather, these embodiments are provided so that this disclosure will be thorough and complete, and will fully convey the scope of the disclosure to those skilled in the art. The present disclosure is defined only by the categories of the claims. In certain embodiments, detailed descriptions of device constructions or processes well known in the art may be omitted to avoid obscuring appreciation of the disclosure by a person of ordinary skill in the art. Wherever possible, the same reference numbers will be used throughout the drawings to refer to the same or like parts.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each layer is exaggerated, omitted, or schematically illustrated for convenience of description and clarity. Also, the size or area of each constituent element does not entirely reflect the actual size thereof.

Angles or directions used to describe the structures of light emitting devices according to embodiments are based on those shown in the drawings. Unless there is, in the specification, no definition of a reference point to describe angular positional relations in the structures of the light emitting devices, the associated drawings may be referred to.

Hereinafter, embodiments will be described in more detail with reference to the annexed drawings.

Figure 2:
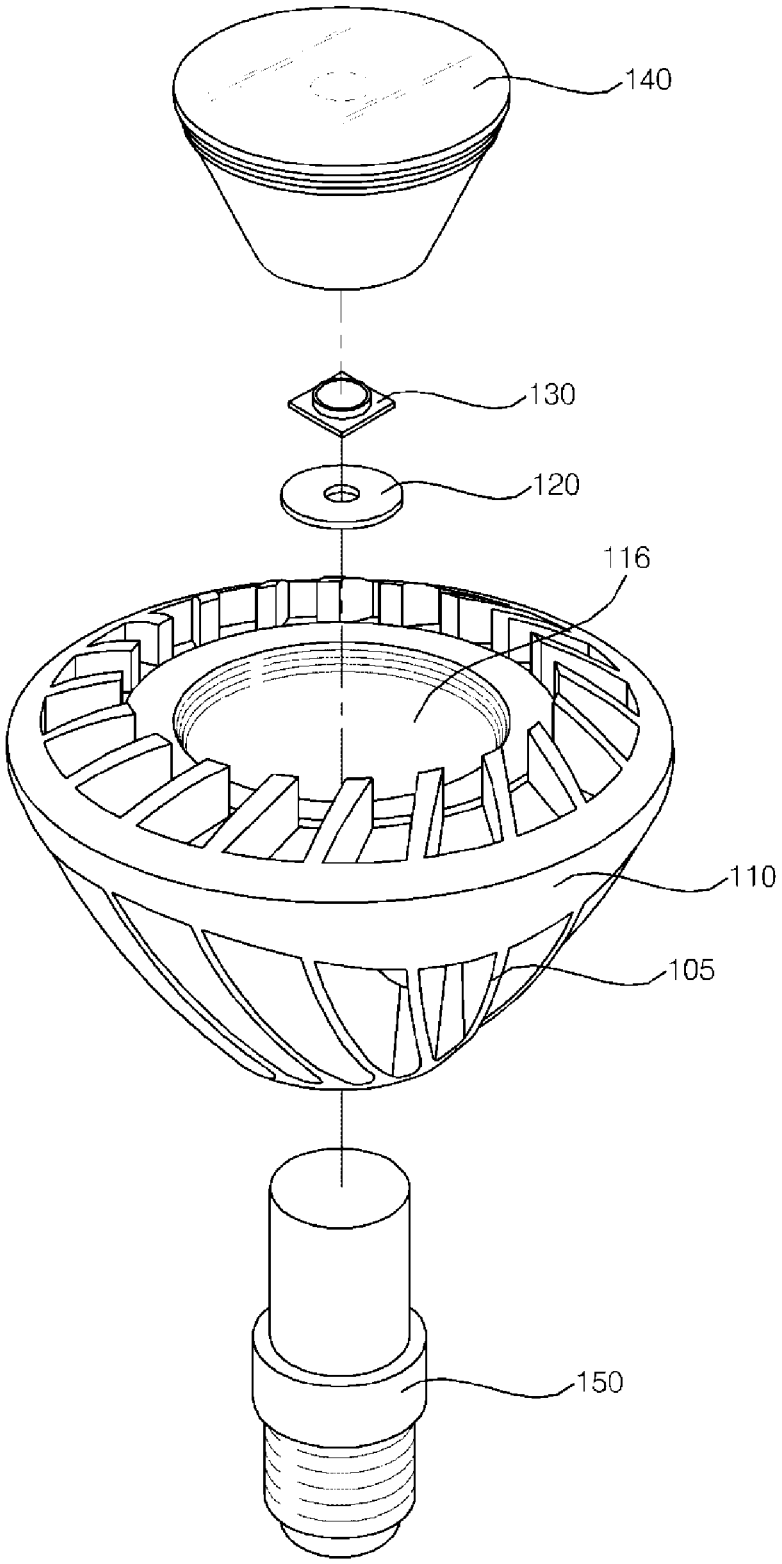
FIG. 2 is an exploded perspective view illustrating a lighting device according to one embodiment.
Figure 3:
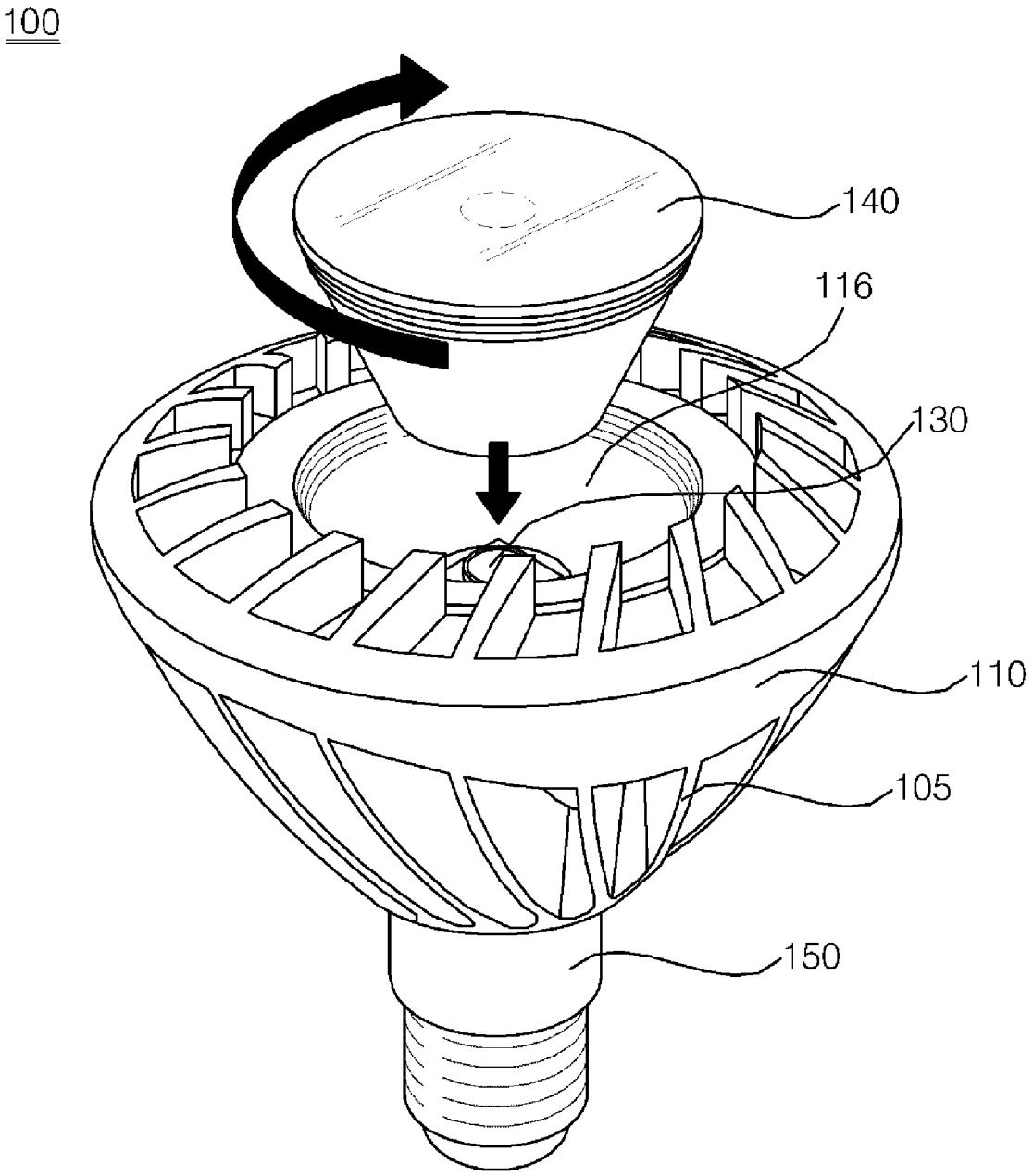
FIG. 3 is an exploded perspective view illustrating a lighting device according to one embodiment.
Figure 4:
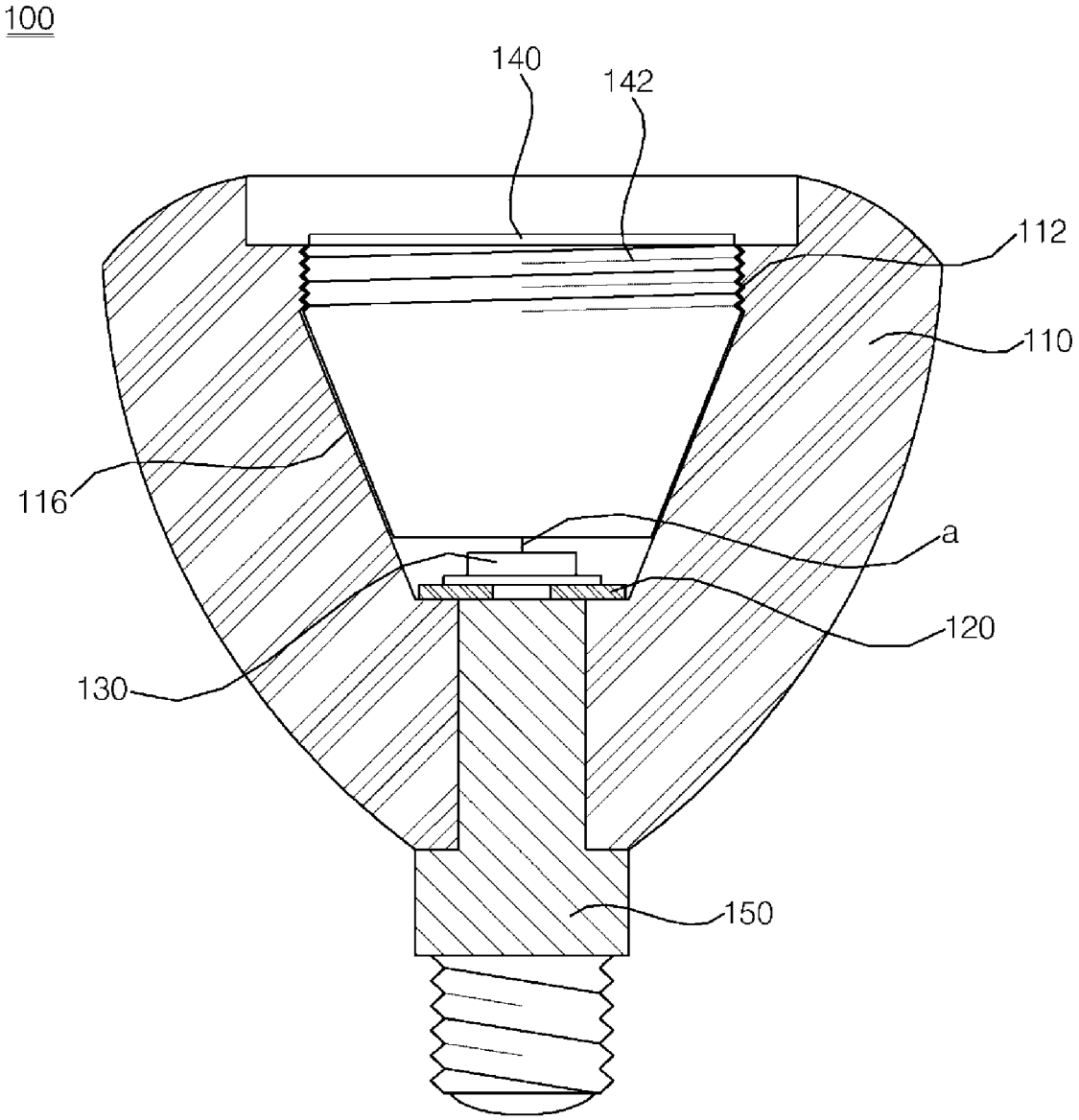
FIG. 4 is a sectional view illustrating the cross-section taken along the direction D-D' of the lighting device of FIG. 1.

FIG. 1 is a perspective view illustrating a lighting device according to one embodiment. FIG. 2 is an exploded perspective view illustrating a lighting device according to one embodiment. FIG. 3 an exploded perspective view illustrating a method for coupling a lens to a body in a lighting device according to one embodiment. FIG. 4 is a sectional view illustrating the cross-section taken along the direction of D-D' of the lighting device of FIG. 1.

Referring to FIGS. 1 to 4, the lighting device of one embodiment includes a body 110 having an upper part to provide a cavity, the upper part being provided with a first screw 112, a light source 130 disposed in the cavity, a power supply 150 disposed at one side of the body 110, to supply power to the light source 130, and a lens 140 disposed on the light source 130 and provided with a second screw 142 coupled with the first screw 112.

The body 110 receives light generated in the light source 130 and radiates the light. The body 110 may be made of a material having superior light emission efficiency. For example, the body 110 may comprise at least one of aluminum (Al), nickel (Ni), silver (Ag), tin (Sn) and a plastic.

When the body 110 comprises a metal material, electric insulating treatment between the body 110 and the power supply 150 may be performed, although the disclosure is not limited thereto. In another embodiment, when the body 110 is made of a plastic having low electric conductivity, the power supply 150 may contact the body 110, although the disclosure is not limited thereto.

The body 110 may comprise a thermoconductive plastic having thermoconductivity higher than a general plastic. The thermoconductive plastic may have a structure that exhibits maximum heat-radiation performance making the best of characteristics such as conduction, convection, and radiation.

The body 110 is provided in an upper part thereof with a cavity 116. The cavity 116 may be formed by a recessed portion of the upper part of the body 110. The body 110 includes an inside wall and a bottom surface to provide the cavity 116. The cavity 116 may be formed on the boundary between the bottom surface formed in the upper part of the body 110 and the inside wall that forms a slope with the bottom surface. A light source 130 or a substrate 120 may be disposed on the bottom surface.

The first screw 112 may be formed on the inside wall to provide the cavity 116. The body 110 may be coupled to the lens 140. The body 110 may be coupled to the lens 140 by screw bonding.

A heat radiator 105 may be formed outside of the body 110. The heat radiator 105 may include a structure to emit heat. The heat radiator 105 may include a plurality of protrusions or grooves continuously formed in a side surface of the body 110 and thus have an increased surface area that contacts air.

The body 110 may have an inner area. The body 110 may include a power supply 150 in the inner area. The body 110 may have an area where the cavity 116 and the power supply 150 are disposed.

The lighting device may further include a substrate 120 disposed on the bottom surface that provides the cavity 116 of the body 110, or on the power supply 150 described below.

The substrate 120 may be electrically connected to the light source 130. The substrate 120 may be electrically connected to the power supply 150. The substrate 120 receives power from the power supply 150 and transfers the same to the light source 130.

The substrate 120 may include a circular plate shape, but it includes various shapes without limiting thereto. For example, the substrate 120 may have a polygonal plate shape.

The substrate 120 may be a circuit pattern-printed insulator. For example, the substrate 120 may include a general printed circuit board (PCB), a metal core PCB, flexible PCB, a ceramic PCB or the like. The substrate 120 may be a chip on board (COB) that is integrated with the light source 130, although the disclosure is not limited thereto.

The substrate 120 may include a material that efficiently reflects light. The substrate 120 may have an upper surface that has color, capable of efficiently reflecting light, such as white or silver.

The lighting device may further include a heat sink (not shown) between the substrate 120 and the body 110. The heat sink (not shown) may transfer heat, which is generated in the light source 130 and is then transferred to the substrate 120, to the body 110.

The substrate 120 may be disposed in the body 110. The heat sink (not shown) may have a portion that is disposed on the bottom surface to provide the cavity 112 of the body 110. The substrate 120 may be disposed between the bottom surface to provide the cavity 112 and the light source 130.

The heat sink (not shown) may be made of a highly thermoconductive material. For example, the heat sink (not shown) may be made of a metal. In another embodiment, the heat sink is made of aluminum (Al). The heat sink (not shown) receives heat generated in the light source 130. The heat sink (not shown) is inserted into the body 110 to transfer heat from the light source 130 into the body 110.

The heat sink (not shown) may be made of a material having high light reflectivity. The heat sink (not shown) may reflect light generated in the light source 130 to an upper part of the body 110.

The light source 130 may be disposed on the bottom surface to provide the cavity 116 of the body 110. A substrate 120 may be disposed between the light source 130 and the bottom surface to provide the cavity 116. A heat sink (not shown) may be disposed between the light source 130 and the bottom surface to provide the cavity 116 of the body 110, but the disclosure is not limited thereto.

The light source 130 may be electrically connected to the power supply 150 described below. The light source 130 may emit light. The light source 130 may include an element that emits light using characteristics of semiconductor materials. For example, the light source 130 may include a light emitting diode (LED).

The light emitting diode (not shown) may convert electrical signals into infrared light or visible light using compound semiconductor characteristics. The light emitting diode (not shown) may be electrically connected to a lead frame (not shown) of a light emitting device package (not shown).

The light source 130 may include a red, green, blue or white light emitting diode that emits red, green, blue or white light, but the type and number thereof are not limited. The light emitting diode may be of a lateral or vertical type, but the disclosure is not limited thereto.

The light source 130 may include a phosphor. The phosphor absorbs light and thereby emits light having a changed wavelength. The phosphor may include at least one of yellow, red and green phosphors, when the light emitting diode is a blue light emitting diode. For example, the phosphor may include at least one of Garnet (YAG, TAG), silicate, nitride, and oxynitride.

The light source 130 may face the bottom of the lens 140. The light source 130 may be spaced from the lens 140 described below. The light source 130 is spaced from the lens 140 by a predetermined distance to allow a greater amount of light to be incident upon the lens 140.

The power supply 150 may be disposed in the body 110. The power supply 150 may be inserted into an area provided in the body 110. The power supply 150 may be electrically connected to the substrate 120. The power supply 150 may be electrically connected through the substrate 120 to the light source 130 and control operation of the light source 130, but the disclosure is not limited thereto.

The power supply 150 may include a support substrate (not shown) and a plurality of components (not shown) mounted on the support substrate (not shown).

The power supply 150 may convert alternating current supplied from the outside into direct current that may be stably used for the lighting device. The power supply 150 may supply a voltage or current required for the lighting device.

Examples of the plurality of components may include, but are not limited to, a direct current convertor that converts alternating current supplied from an exterior power source into direct current, a driver (not shown) to control driving of the light source 130, an electrostatic discharge (ESD) protective element (not shown) to protect the light source 130 from an electric shock (not shown) or the like. The power supply 150 may be provided in a lower part thereof with a socket connected to an exterior power source.

The power supply 150 prevents noise of alternating current input outside from being transferred to the light source 130. The power supply 150 may include a band-pass filter that removes ripples or noise of the power rectified into direct current. The power supply 150 may convert filtered direct current into power that satisfies specifications required for the light source 130.

The lens 140 is disposed on the light source 130 and is coupled to the body 110. The lens 140 receives light from the light source 130 and emits light. The lens 140 focuses or emits light generated in the light source 130. The lens 140 may be a circular plate, but the shape thereof may be changed according to the shape of the cavity 116 of the body 110 without limiting thereto.

The lens 140 may partially or entirely have a predetermined curvature. The lens 140 may be spaced from the light source 130 by a predetermined distance. The lens 140 may extend in a depth direction of the cavity 112 such that it corresponds to the light source 130. When the number of the light sources 130 is plural, the lens 140 may have a plurality of parts that extend in the depth direction of the cavity 112.

The lens 140 may have a diameter that decreases from the top to the bottom. For example, the lens 140 has a maximum diameter in a part thereof that contacts the top of the body 110 and a minimum diameter in a part thereof that faces the light source 130. The lens 140 may have a cylindrical shape, the diameter of which is changed according to height.

An inclination of the side surface of the lens 140 may have the same as that of the inside wall of the cavity 116.

The lens 140 may be fixed on the body 110 by screw coupling. Referring to FIG. 3, the lens 140 may be coupled to the body provided with a first screw 112 on the cavity 116. The lens 140 may be provided at the side thereof with a second screw 142. As shown in FIG. 3, the second screw 142 of the lens 140 may be coupled to the first screw 112 of the body 110.

An adhesion unit (not shown) may be disposed between the lens 140 and the body 110. The adhesion unit (not shown) prevents movement of a region where the lens 140 is coupled to the body 110. The adhesion unit (not shown) may be filled between the lens 140 and the body 110. The adhesion unit (not shown) may include a material to adhere metal to non-metal.

The adhesion unit (not shown) adheres the lens 140 to the body 110. The adhesion unit (not shown) may be disposed between the first screw 112 and the second screw 142. The adhesion unit (not shown) prevents tightening or loosening of screw coupling caused by exterior physical shock. The adhesion unit (not shown) enhances optical orientation or physical durability of the lighting device. The adhesion unit (not shown) may include silicone (Si), but the material of adhesion unit is not limited thereto.

FIG. 4 is a sectional view taken along the direction D-D' of the lighting device of FIG. 1.

Referring to FIG. 4, the lens 140 may be disposed on the light source 130. The lens 140 focuses light irradiated from the light source 130 and emits the same upwardly. The lens 140 may be spaced from the light source 130. The lens 140 is spaced from the light source 130 by a predetermined distance to prevent exterior physical shock from being transferred to the light source 130. The lens 140 may be coupled to the body 110 by screw coupling.

When the second screw 142 formed in the lens 140 is coupled to the first screw 112 formed in the body 110, the lens 140 may be spaced from the light source 130.

The side of the cavity 116 may be spaced from the side of the lens 140. The cavity 116 may be coated with a highly reflective material, for example, aluminum (Al) or silver (Ag), but the material is not limited thereto. The cavity 116 may reflect light emitted from the light source 130. The cavity 116 may reflect light irradiated from the light source 130 toward the lens 140.

The power supply 150 may be disposed in an area present in the body 110. The power supply 150 may be electrically connected to the substrate 120. The power supply 150 is disposed in the body 110 to improve electric stability.

FIGS. 5 to 9 are sectional views illustrating a lighting device according to one embodiment.

Figure 5:
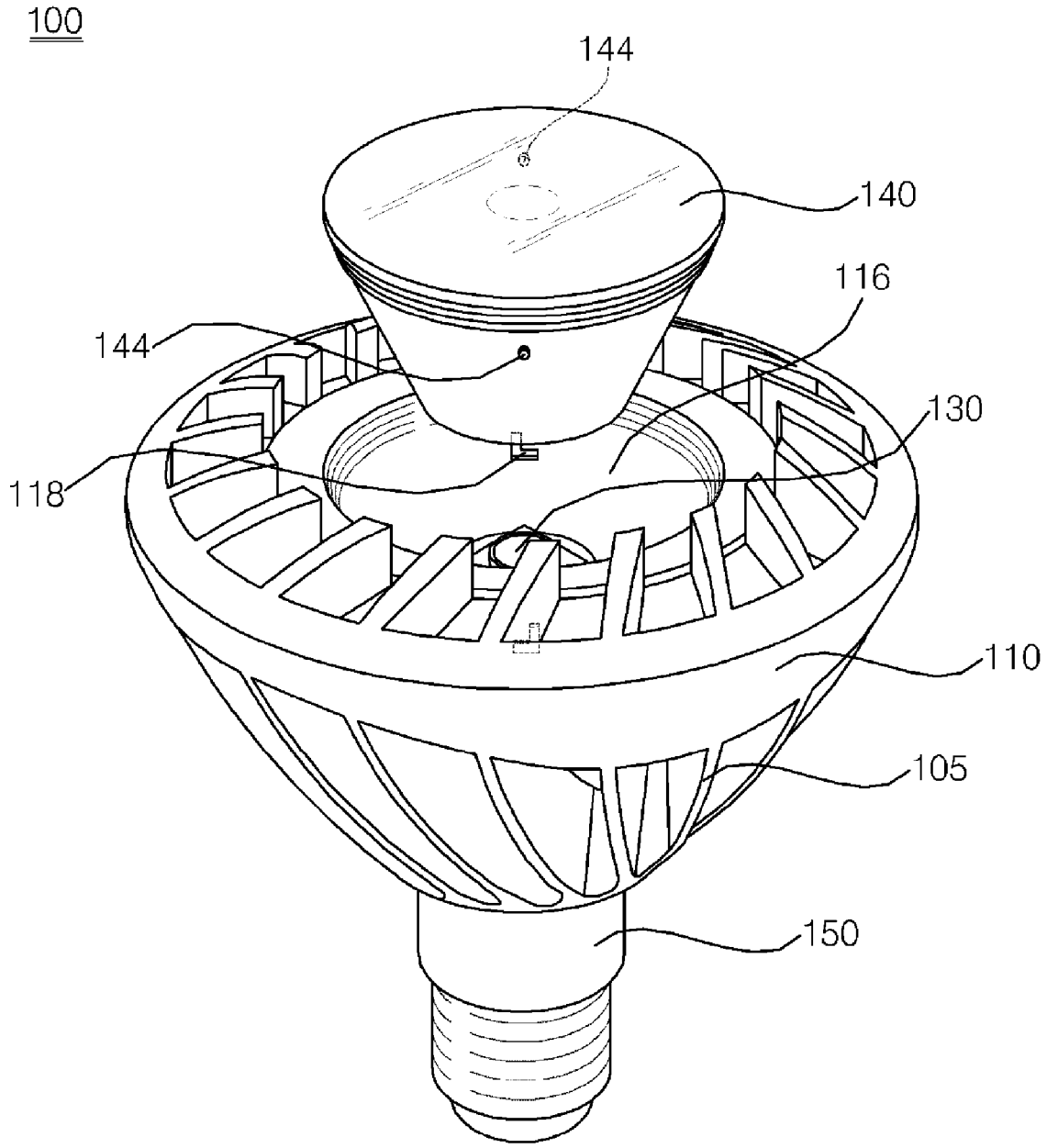
FIGS. 5 to 9 are sectional views illustrating a lighting device according to one embodiment.

Referring to FIG. 5, the lens 140 may include a first protrusion 144 having a protruded side. The first protrusion 144 may be present in plural.

The body 110 may include a groove 118 formed by recessed portions of the inside wall to provide the cavity 116. The groove 118 may be present in plural. The number of the grooves 118 may be the same as the number of the first protrusions 144.

The groove 118 may be coupled to the first protrusion 144. When the numbers of the groove 118 and the first protrusion 144 are plural, a plurality of grooves 118 may correspond to a plurality of first protrusions 144. The lens 144 may be fixed on the body 110 by which the first protrusion 144 is coupled to the groove 118.

The groove 118 spaces the lens 144 from the light source 130. The groove 118 prevents a phenomenon in which the lens 144 is excessively deeply embedded in the body 110 and thus contacts the light source 130. The lens 144 is spaced from the light source 130 to prevent defects caused by deterioration.

Figure 6:
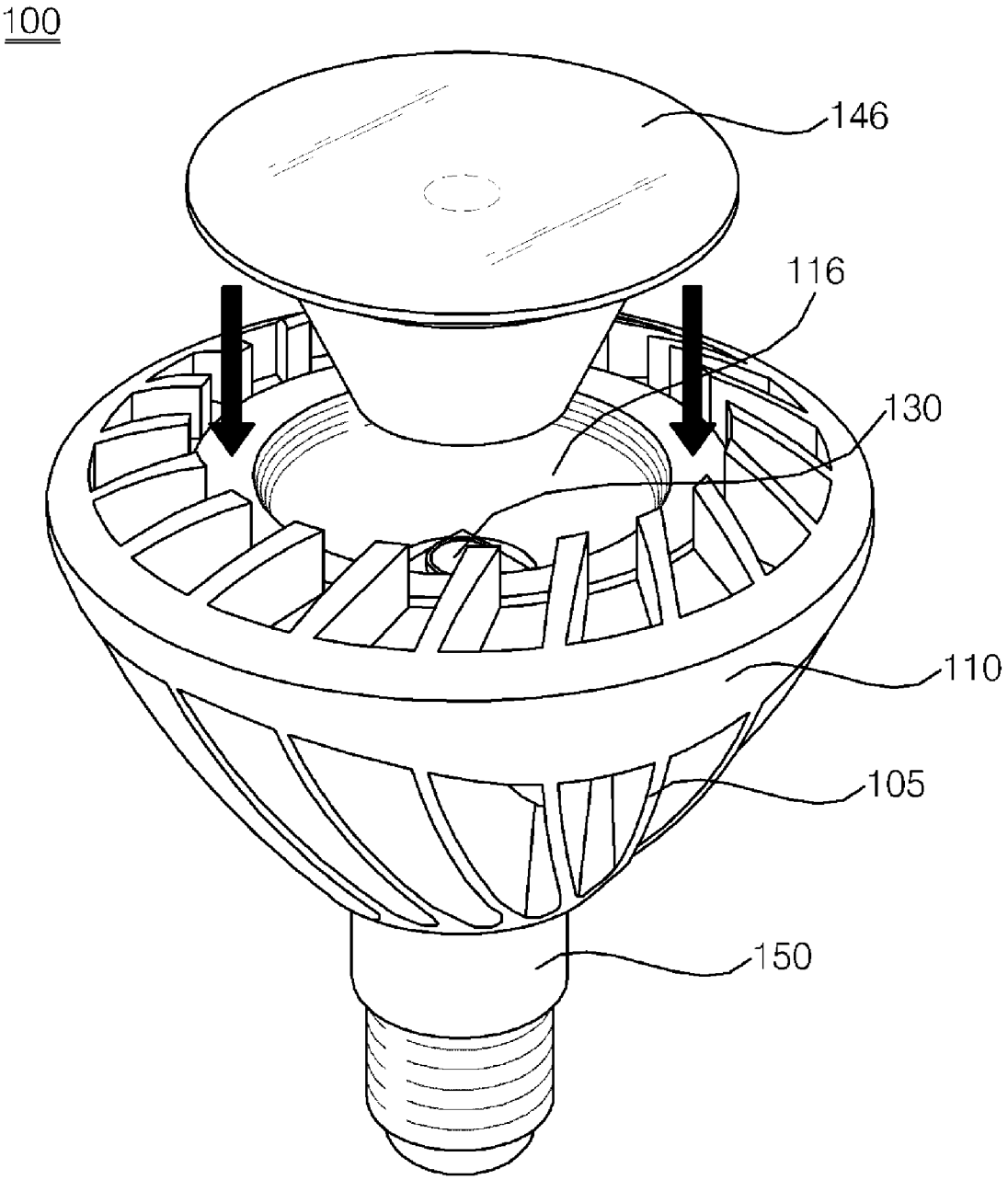

FIG. 6 is a perspective view illustrating a lighting device according to another embodiment.

The lens 140 may extend to the top of the body 110.

For example, as shown in FIG. 6, the lens 140 may include a circular plate 146, the top of which extends in a circumferential direction.

The circular plate 146 may be formed on the second screw 142 of the lens 140. The disclosure may include various embodiments in which the shape of the circular plate of lens 140 is not limited. For example, the disclosure may include other embodiments in which a side surface of the lens is fixed to the body 110. The circular plate 146 may contact the top of the body 110.

The circular plate 146 firmly couples the lens 140 to the body 110. The circular plate 146 prevents a phenomenon, in which the lens 140 descends to the bottom surface to provide the cavity 116, through screw coupling between the lens 140 and the body 110. The circular plate 146 prevents the lens 140 from contacting the light source 130.

The circular plate 146 may contact the top of the body 110. The circular plate 146 contacts the top of the body 110 and thereby minimizes introduction of foreign matter into the cavity 116.

The adhesion unit (not shown) may be disposed between the circular plate 146 and the top of the body 110. The adhesion unit (not shown) prevents occurrence of a gap between the lens 140 and the top of the body 110. The adhesion unit (not shown) blocks introduction of foreign matter into the light source 130.

The adhesion unit (not shown) may comprise a material to adhere metal to non-metal. For example, the adhesion unit (not shown) may include silicon (Si), but may include various materials without limitation thereto.

Figure 7:
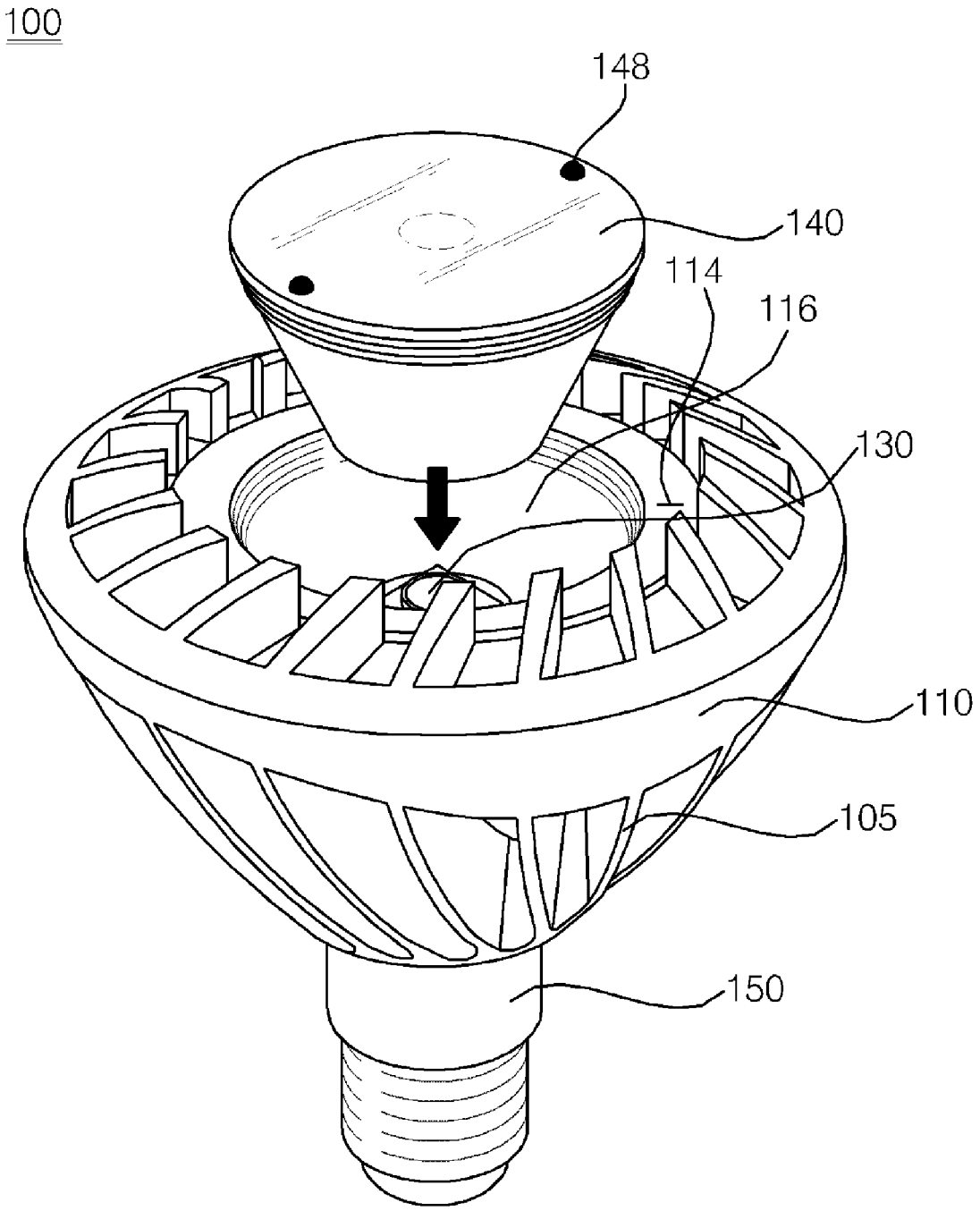

Referring to FIG. 7, the lens 140 may include a second protrusion 148 formed by a protruded portion of both ends of the diameter of the top of the lens 140. The second protrusion 148 may be present in plural. For example, the second protrusion 148 may be formed at both ends of the diameter of the top thereof 140.

The body 110 may be provided in a portion of the top thereof with a first mark 114. The first mark 114 may be formed on the body 110 by printing or injection molding, but there are various embodiments of the formation method of the first mark 114 without limitation thereto.

The first mark 114 enables the lens 140 to be disposed at a suitable position of the body 110 using the position relation with the second protrusion 148.

Figure 8:
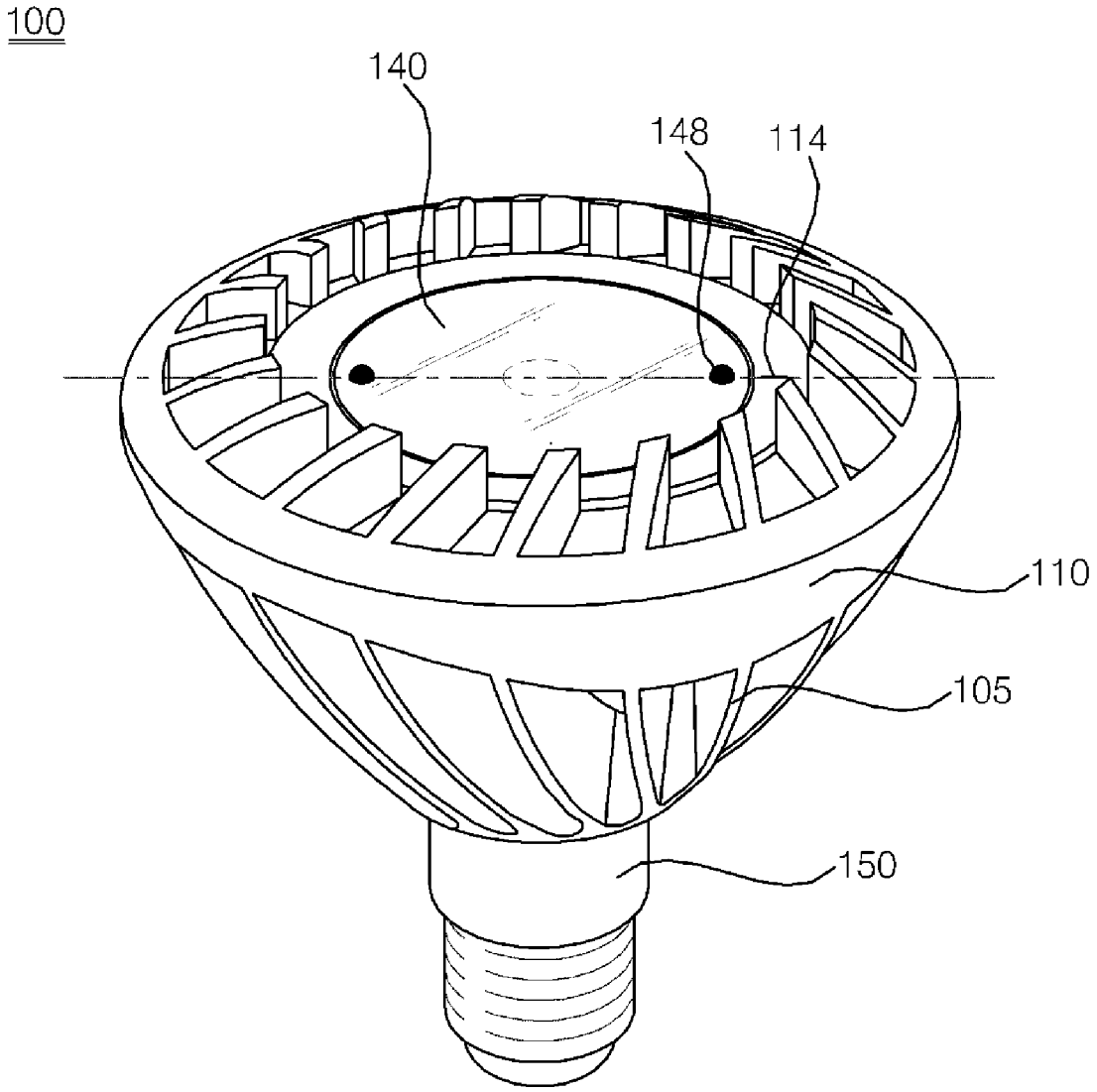

For example, referring to FIG. 8, when the second protrusion 148 is formed at both ends of the diameter of the top thereof 140, two second protrusions 148 and the first mark 114 may be disposed in a straight line. When the lens 140 is coupled to the body 110 by screw coupling, the lens 140 is spaced from the light source 130 by a suitable distance, while the screw is turned, until two second protrusions 148 and the first mark 114 are disposed in a straight line.

The light source 130 is spaced from the lens 140 to improve optical properties in which light generated in the light source 130 is incident on the lens 140. The light source 130 is spaced from the lens 140 to improve durability in which physical shock applied to the lens 140 from outside is transferred to the light source 130.

Figure 9:
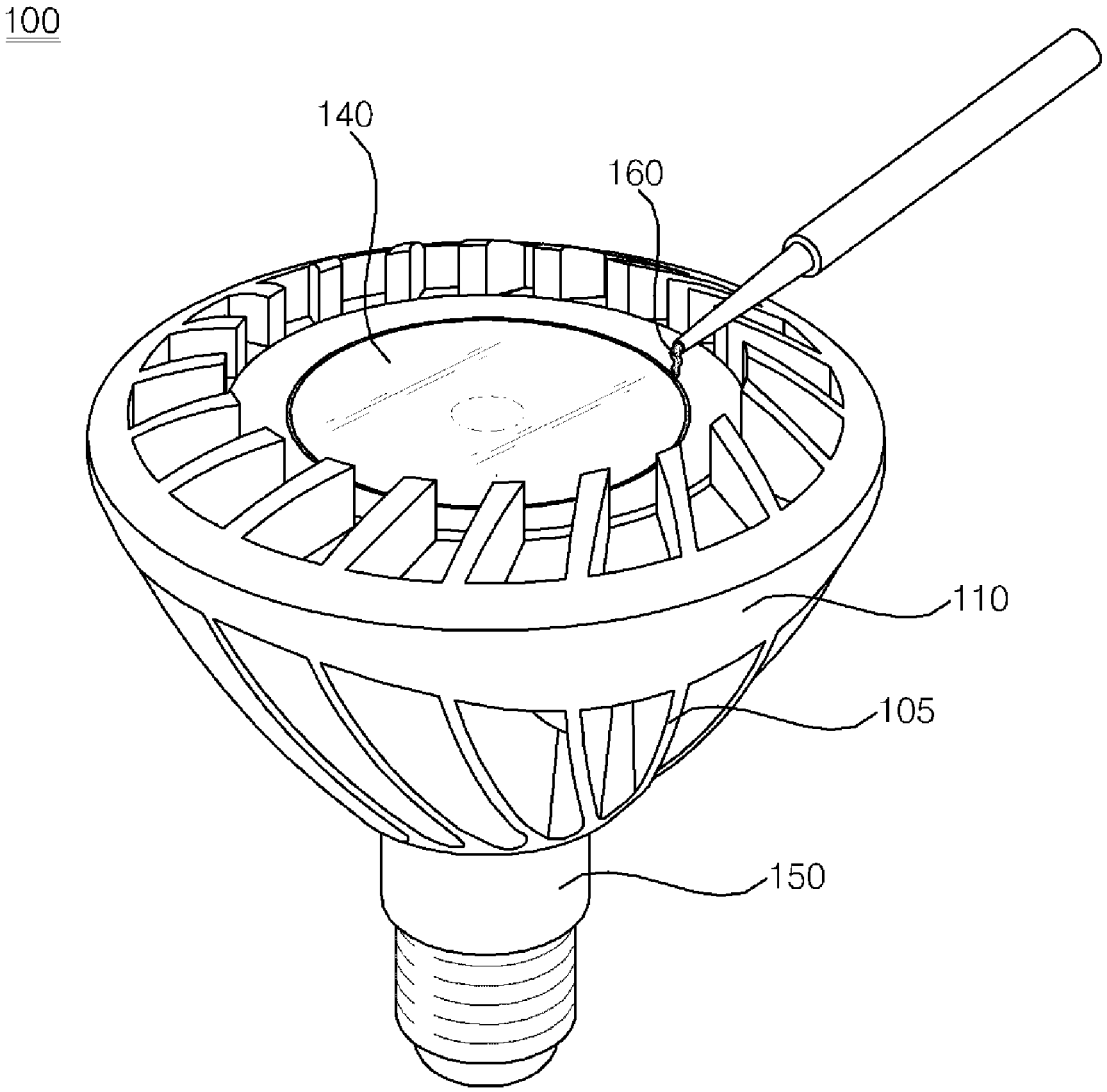

Referring to FIG. 9, in the lighting device according to one embodiment, an adhesion unit 160 may be disposed between the lens 140 and the body 110. The adhesion unit 160 may comprise a material to adhere metal to non-metal. For example, the adhesion unit 160 may contain silicon (Si). The adhesion unit 160 may be disposed between the first screw 112 and the second screw 142, but the position thereof is not limited thereto.

The lighting device according to one embodiment includes a heat-radiator to increase a surface area at the outside of the body, to improve heat radiation property.

The lighting device according to one embodiment is provided at the inside of the body with a power supply, to provide electrical stability.

The lighting device according to one embodiment exhibits improved mechanical stability, since the protrusion at the side of the lens is coupled to the groove of the body.

In the lighting device according to one embodiment, the top of the lens extends in the form of a circular plate in a circumferential direction, the lens is firmly coupled to the body and introduction of foreign matter into the light source can be thus prevented.

In the lighting device according to one embodiment, an adhesion unit containing silicon (Si) is disposed between the body and the lens, to prevent introduction of foreign matter into the light source and thereby enhance durability.

In the lighting device according to one embodiment, the lens is coupled to the body by screw coupling, optical connection between the lens and the light source becomes strong and optical efficiency can be thus maximized.

Particular features, structures, or characteristics described in connection with the embodiment are included in at least one embodiment of the present disclosure and not necessarily in all embodiments. Furthermore, the particular features, structures, or characteristics of any specific embodiment of the present disclosure may be combined in any suitable manner with one or more other embodiments or may be changed by those skilled in art to which the embodiments pertain. Therefore, it is to be understood that contents associated with such combination or change fall within the spirit and scope of the present disclosure.

What is claimed is:

1. A lighting device comprising:

an outer body having an inner wall to form a cavity, the inner wall being provided with a first threaded connection formed thereon and an outer wall forming a heat sink;

a light source disposed within the cavity;

a power supply disposed at one end of the body to supply power to the light source; and a lens disposed in the cavity above the light source, the lens being provided with a second threaded connection formed on an outer wall thereof and being coupled to the first threaded connection, wherein the body includes a groove formed by recessed portions formed in the inner wall, the groove being located below the first threaded connection, wherein the lens includes a first protrusion protruding outwardly from the outer wall of the lens, and wherein the groove is coupled to the first protrusion to keep the lens spaced from the light source.

2. The lighting device according to claim 1, further comprising:

adhesive to adhere the lens to the body.

3. The lighting device according to claim 1, wherein the lens extends to a top of the body.

4. The lighting device according to claim 1, wherein the lens includes a second protrusion formed in a top of the lens, wherein the body include a first mark formed by the top of the body, and wherein the first mark and the second protrusion are disposed along a straight line.

5. The lighting device according to claim 1, wherein a diameter of the lens decreases nearer to the light source, and the light source faces the bottom of the lens.

6. The lighting device according to claim 1, wherein the lens comprises a circular plate that extends in a circumferential direction on a top of the second threaded connection, and the circular plate contacts the top of the body.

7. The lighting device according to claim 6, further comprising:

an adhesive to adhere the bottom of the circular plate to the top of the body.

8. A lighting device comprising:

an outer body having an inner wall to form a cavity, the inner wall being provided with a first threaded connection formed thereon and an outer wall forming a heat sink;

a light source disposed within the cavity;

a power supply disposed in the body to supply power to the light source; and a lens disposed in the cavity above the light source, the lens being provided with a second threaded connection formed on an outer wall thereof and being coupled to the first threaded connection so that the lens is spaced from the light source, wherein the body includes a groove formed by recessed portions formed on the inner wall, the groove is located below the first threaded connection, wherein the lens includes a first protrusion protruding outwardly from the outer wall of the lens, and wherein the groove is coupled to the first protrusion.

9. The lighting device according to claim 8, further comprising:

an adhesive to adhere the lens to the body.

10. The lighting device according to claim 9, wherein the adhesion unit is disposed between the first threaded connection and the second threaded connection.

11. The lighting device according to claim 8, wherein the lens has a portion that extends to the top of the body.

12. The lighting device according to claim 8, wherein the lens includes a second protrusion formed in a top of the lens, wherein the body include a first mark formed on the top of the body, and wherein the first mark and the second protrusion are disposed along a straight line.

13. The lighting device according to claim 12, wherein the first mark spaces the lens from the light source.

14. The lighting device according to claim 8, wherein a diameter of the lens decreases as the lens is nearer to the light source, and the light source faces the bottom of the lens.

15. The lighting device according to claim 8, wherein the lens comprises a circular plate that extends in a circumferential direction on a top of the second threaded connection, and the circular plate contacts the top of the body.

16. The lighting device according to claim 15, further comprising:

an adhesive to adhere the bottom of the circular plate to the top of the body.

17. The lighting device according to claim 8, wherein an inclination of the side of the lens is the same as an inclination of the inside wall.

* * * * *